US007309218B1

(12) United States Patent
Lewis et al.

(10) Patent No.: US 7,309,218 B1
(45) Date of Patent: Dec. 18, 2007

(54) GEAR PUMP

(76) Inventors: Graham Louis Lewis, 1923 Perodeau St., Vaudreuil-Dorion, Quebec (CA) 57V 8P7; Max Yablonovitch, 28 Fredmir St., Dollard-des-Ormeaux, Quebec (CA) H9A 2R2

( * ) Notice: Subject to any disclaimer, the term of this patent is extended or adjusted under 35 U.S.C. 154(b) by 479 days.

(21) Appl. No.: 10/985,169

(22) Filed: Nov. 10, 2004

(51) Int. Cl.
*F01C 1/18* (2006.01)

(52) U.S. Cl. ..... 417/360; 417/410.4

(58) Field of Classification Search ..... 417/360, 417/410.4; 418/206.1, 206.6
See application file for complete search history.

(56) References Cited

U.S. PATENT DOCUMENTS

| | | | | |
|---|---|---|---|---|
| RE25,567 | E * | 5/1964 | Lorenz | 418/9 |
| 3,263,425 | A * | 8/1966 | Rohde | 60/475 |
| 5,755,566 | A | 5/1998 | Marsillo et al. | |
| 6,033,193 | A * | 3/2000 | Pieters et al. | 417/420 |
| 6,210,138 | B1 * | 4/2001 | Cortez | 418/132 |
| 6,764,284 | B2 * | 7/2004 | Oehman, Jr. | 417/360 |
| 6,857,860 | B1 * | 2/2005 | Zimmermann et al. | 417/410.4 |

OTHER PUBLICATIONS

Steripump, Nova Packaging Systems, 7 New Lancaster Rd., Leominster, MA, 01453 shown disassembled, p. 3.

Fillit/PowerFillit, Nova Packaging Systems, 7 New Lancaster Rd., Leominster, MA, 01453 pp. 1, 2, 4, 5.

Swiftpack-King, Swiftpack House, 3 Arden Road, Arden Forest Ind. Estate, Alcester, Warwickshire, UK.

* cited by examiner

*Primary Examiner*—Anthony Stashick
*Assistant Examiner*—Vikansha Dwivedi
(74) *Attorney, Agent, or Firm*—Richard L. Marsh

(57) ABSTRACT

A pump suitable for use with contamination-sensitive fluids such as food products or pharmaceutical fluids includes an outer casing containing an internal cavity, the outer casing having an enlarged opening on one end, a second opening on an opposite end, a first inlet port and a first outlet port. The internal cavity has pumping parts disposed substantially within the cavity, the pumping parts comprising end blocks each having a drive and idler shaft support, a drive shaft and an idler shaft, a plurality of pumping wheels, and a center block with an internal cavity defining a pumping chamber. The enlarged opening of the outer casing is sealed by an end cap, an elastomeric seal and a quickly removable industry-standard clamp. The second opening of the outer casing is provided for the drive shaft and is sealed by an elastomeric shaft seal. The pumping wheels are rotationally active with, but not axially retained, on respective support shafts and are substantially free to slide on their respective axes.

3 Claims, 5 Drawing Sheets

MOUNTED PUMP ASSEMBLY
SIDE ELEVATION

EXPLODED VIEW OF PUMP

PUMP DRIVE ASSEMBLY

GEAR PUMP

FIELD OF THE INVENTION

The invention relates to a pump designed for pumping materials over a wide range of viscosities and is particularly advantageous when pumping contamination-sensitive fluids. More particularly, the invention also extends to a pump which can be mounted at any convenient rotary angle that is substantially coaxial with the drive shaft.

The invention also relates to a pump which essentially contains no threaded fasteners.

The invention further extends to a pump where the internal functioning components are substantially free to find the position of least communication with the pumping wheels that are disposed substantially in the pumping chamber.

BACKGROUND OF THE INVENTION

Gear pumps enjoy wide acceptance in many fluid pumping applications. To drive a gear pump, it suffices to impart rotary movement to one of the pumping wheels through the drive shaft and coupling connecting to a prime mover, such as an electric motor. The rotary motion will be transmitted to the idler shaft through the arrangement of meshing projections disposed on the pumping wheels and the engaging surface between the pumping wheels and both shafts. In many instances where such pumps are used, it may be desirable to orient the inlet and outlet ports on the pump casing to suit a wide variety of product handling configurations where the product supply reservoir may be positioned in a variety of locations along some vertical axis with respect to the actual position of the pump. Typical configurations would include placement of the reservoir above or below the pump as the situation dictates.

When pumping contamination-sensitive fluids such as food products or pharmaceutical fluids, it is also commonly required to disassemble, clean and reassemble the pump on a daily, if not more, basis. A pump that can be quickly dismantled, easily cleaned and rapidly brought back into service would present itself as being particularly advantageous. Functioning surfaces that are in contact and move relative to each other tend to produce unwanted particulates abraded from those surfaces. It is desirable to minimize the production of unwanted particulates, and as such, a pump whose functioning components are able to find the position of least communication with each other within the pump would be advantageous.

Where possible, it would also be advantageous to substantially transfer various abrasion producing forces to a member exterior to the pump casing. It is also desirable to have a gear pump with a limited number of ingress points to minimize possibilities for contamination of the sensitive fluids that are typically handled in food and pharmaceutical packaging environments.

A functioning gear pump must contain certain elemental features. These features can be present in a wide variety of configurations that may reflect the application, cost considerations and experience of the designer. In most gear pump designs, there is typically a need for one or more pumping wheels, a means for transferring rotational forces from a prime mover to at least one pumping wheel, a means for providing support and a guide for at least one shaft on which at least one pumping wheel is disposed, a means for maintaining a separation between the fluid being pumped and outside contaminants, a means for keeping the various members assembled and a means for maintaining a preferred alignment of the functioning members.

Conventional so-called gear pumps in existence typically handle the required internal functions in a wide variety of ways. However, they tend to include the need for threaded fasteners, integrally applied to hold the various pump components in a preferred relationship to each other. This method of construction where through bolts or threaded rods go through various machine members is often referred to as 'tie-rod' assembly, and is quite common in pneumatic and hydraulic cylinder assembly where one or more threaded rods are used to effect end cap retention on a cylinder.

An example of this kind of pump with 'tie-rod' construction would be the 'Steripump', which is sold by Nova Packaging Systems, 7 New Lancaster Road. Leominster, Mass. 01453. This pump features a plurality of stacked wafers that include end blocks, end caps and a member disposing a gear chamber. The assembly is held together with three threaded fasteners that go through the various wafers that make up the pump assembly. The issues associated with this mode of construction include a plurality of exposed circumferential gaps between the wafers that require the need for multiple o-ring face seals between adjacent wafers. The wafers themselves each require three openings for the passage of the threaded fasteners. With this type of construction there are associated assembly, disassembly and cleaning issues. If there is a deviation from the intended geometry of the pump components, tie-rod construction may inadvertently force pump members to possibly attain a location within the bolted-together stack of components which may not be the location of least communication between the members. As well, a further result of possible misalignment of the pumping chamber with respect to the pumping wheels would be friction that may tend to abrade one or more of the surfaces in contact to produce unwanted particles from those surfaces. Those particles would undesirably mix with the fluid being pumped.

One of the goals of the current invention is to minimize the production of particles abraded from the working surfaces of the pumping components.

Conventional gear pump bodies are typically mounted to the prime mover in a restricted single orientation that may limit the possible configurations of the inlet and outlet ports.

It is a further goal of this invention to allow the user to conveniently orient the pump housing to suit the configuration requirements of the fluid pumping situation at hand.

Once again, referencing the 'Steripump' from Nova Packaging Systems, that particular gear pump can be mounted in only the configuration that is arranged by the factory at the time of ordering the pump. One arrangement offered in their 'Fillit' machine offers a substantially bottom inlet port and another model, the 'Power Fillit' offers a substantially top inlet port. Modification of the factory-supplied arrangement by the user to suit a different supply reservoir arrangement would require extensive and impractical modifications to the host machine.

U.S. Pat. No. 5,755,566 Marsillo, et al. entitled 'Self Driving Fluid Pump', discloses an innovative pumping wheel configuration disposed in an arrangement of parts substantially held together by a 'tie-rod' arrangement of bolts. From the 'Description of Preferred Embodiments' in U.S. Pat. No. 5,755,566 we read: "The housing 12 includes a central portion 22 that is integrally formed with the inlet port 13 and with the outlet port 16. A top cover 24 and the bottom cover 26 are mounted on respective sides of the central section 22 by using suitable fasteners such as bolts 27. The top cover 24 differs from the bottom cover 26 by the provision of an aperture to accommodate the rotary shaft 18. This arrangement allows the pump 10 to be easily disassembled, simply by removing the bolts 27 in order to gain access to the internal mechanism for cleaning or maintenance."

Swiftpack-King, Swiftpack House, 3 Arden Road, Arden Forest Industrial Estate, Alcester, Warwickshire, UK., offers their 'King' pump which features a similar threaded tie rod construction, this time with 2 threaded rods on either end of a member disposing a gear chamber through which the threaded rods do not pass. The member disposing the gear chamber is however rigidly maintained by tie rod assembly at some potentially variable location between the end blocks that are positioned on either side of the member disposing the gear chamber and pressed against the member disposing the gear chamber. This method of assembly may force the member disposing the gear chamber into a non-minimal cooperation with other members of the functioning gear pump assembly. The 'King' pump as well features pumping wheels that are pinned to their support shafts. In addition to previously mentioned issues with this construction, the pinned construction arrangement may present itself as a potential cleaning issue as there may be a requirement in some pumping applications to disassemble the pumping wheels for thorough cleaning during product change-overs and end of run conditions. A gear pump with fewer seals would also be advantageous and would constitute a significant improvement in terms of reducing potential leaks and possible ingress of unwanted materials. The prime mover side retaining end block of the 'King' pump assembly is threaded in two locations and the front end plate has clearance holes for passing the threaded tie rods. The two end caps each require o-ring face seals to prevent leakage and to reduce ingress of unwanted contaminants. This pump also features removable inlet and outlet port assemblies which require additional seals for containment of pumped liquid. Finally there is the drive shaft seal. In total, this pump requires five elastomeric seals for normal operation. As elastomeric seals are selected to be compatible with the chemical characteristics of the fluid products being pumped, it is necessary to have available an assortment of elastomeric seals molded from various compounds as each situation dictates.

Conventional gear pumps typically feature some alignment mechanism such as one or more alignment pins or reference marks, to ensure a preferred functioning alignment of the various required pump elements. This can be a source of error and damage when incorrectly assembling the pumps for preferred operation. The alignment pins require corresponding recesses. Both pins and recesses can be quite small. The pins can be easily lost or misplaced. The recesses are also an issue when it comes to cleaning or servicing the pump. It is a further goal of the current invention to provide a pump assembly where a single alignment element, an extended bushing, acting in communication with a receiving recess disposed in the pump body and coaxial with the drive shaft opening, is substantially the only alignment mechanism required to ensure that the pump has been assembled in the preferred manner.

OBJECTIVE AND STATEMENT OF THE INVENTION

An object of the present invention is to provide a pump that overcomes or at least alleviates the deficiencies associated with prior art devices.

A further object of the present invention is to provide a pump with increased suitability for use with contamination-sensitive fluids as may be encountered in the pharmaceutical or food processing industries.

A further object of the present invention is to provide a pump that can be oriented in any rotational position about the axis of the drive shaft to easily adapt to any required orientation of the inlet and outlet ports.

A further object of the present invention is simplified construction where the operational parts of the pump are encased inside a separate containment vessel, a sealable chamber that has a minimum number of openings and requirements for seals.

A further object of the present invention is to provide a gear pump that does not require threaded fasteners for assembly and operation.

A further object of the present invention is to provide a gear pump where certain internal members are able to find their position of least communication to reduce internal friction that may lower production of unwanted particles.

A further object of the present invention is to have a gear pump where the preferred alignment of the various members is not dependent on extra members not central to the actual functioning of the gear pump, such as added alignment pins or reference marks.

As embodied and broadly described herein, the invention provides a pump comprising: a casing having an internal cavity where the casing acts as a containment vessel, a protected functional pumping assembly separated from outside variables such as unwanted contaminants, a plurality of internal sections whose relationship is to provide the substantial functionality of a gear pump, an arrangement on the exterior of the pump casing substantially coaxial with the drive shaft, that permits mounting and running the pump with any rotational orientation of the main pump body along the axis of the drive shaft, an extended drive shaft support wear bushing that acts as an alignment mechanism to preferably maintain at least one of the internal functioning pump components in a preferred axis to the pump casing, a first inlet port on the pump casing for admitting fluid into the pump casing, a first outlet port on pump casing for discharging fluid from the internal pumping chamber member, a second inlet port on the internal pump chamber member to permit fluids to enter pumping chamber, a second outlet port on internal pumping chamber for discharging pumped fluid from pumping chamber, a first and second pumping wheels mounted for rotation in the pumping chamber about spaced apart rotation axes, each pumping wheel including a set of angularly spaced projections located in a generally common plane, the set of projections of one pumping wheel being in a condition of mesh with the set of projections of the other pumping wheel.

BRIEF DESCRIPTION OF THE DRAWINGS

Detailed descriptions of preferred embodiments of the invention are provided herein with reference to the following drawings, in which.

Figure 1:
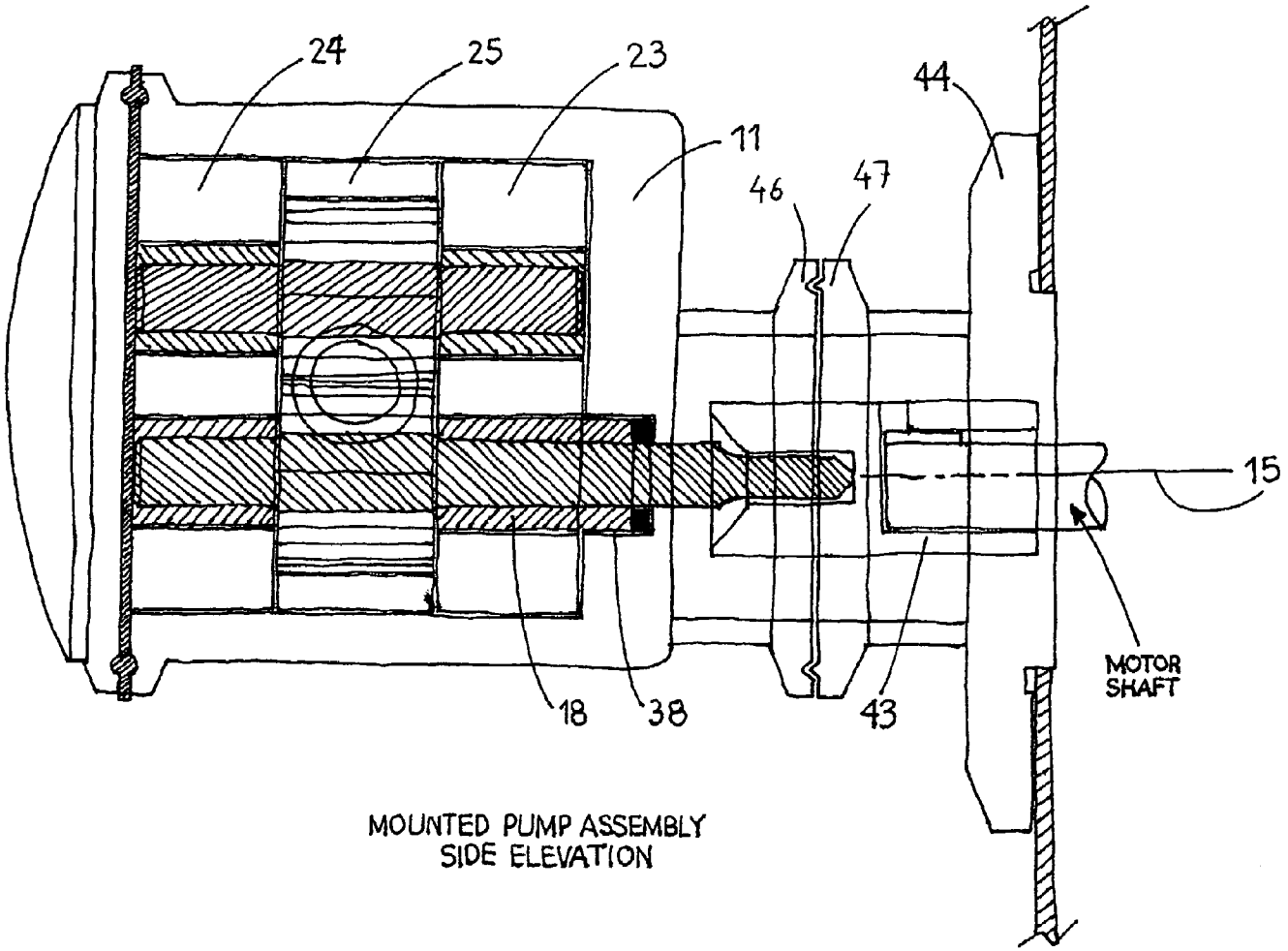
FIG. 1 is a side elevation view of an assembled pump in accordance with the invention. It illustrates the relative positions of the components disposed within the cavity of the pump body and the rotary union arrangement between the gear pump casing and the docking plate that receives the pump casing at any rotational angle about an axis substantially along the drive shaft axis.

In the drawings, preferred embodiments of the invention are illustrated by way of example. It is to be expressly understood that the description and drawings are only for the purpose of illustration and as an aid to understanding, and are not intended as a definition of the limits of the invention. It should also be pointed out that the pump can be used for transporting materials other than contamination sensitive substances without departing from the spirit of the invention.

DESCRIPTION OF PREFERRED EMBODIMENTS

Referring now to the drawings, FIG. 1 illustrates a pump constructed in accordance with the present invention that is particularly well suited for pumping contamination sensitive fluids. FIG. 1 further illustrates a housing 11, preferably made of stainless steel to be compatible with regulations concerning the handling of products intended for human consumption. The pump housing 11, substantially acting as a containment vessel for the pump members 18-35 disposed within pump housing 11 and substantially disposing first end block 23, middle block 25, second end block 24 and first rotary union 46 disposed on the pump casing 11. Second receiving rotary union 47 is disposed on the docking plate 44. It is possible to implement the mounting of rotary union 46 at any rotational position to receiving rotary union 47 and then secure the assembly in the preferred orientation with an industry standard circumferential clamp 48 that draws the two halves of the rotary union close enough to prevent relative movement between members 46 and 47 until it is desired to loosen clamp 48 and re-orient the pump casing 11 with respect to the docking plate 44.

FIG. 1 also illustrates the extended bushing 18, being received by recess 38 in the pump casing 11, extended bushing 18 acting to substantially maintain end block 23 and any members cooperating with end block 23 in a preferred parallel alignment with the axis 15 of drive shaft 27.

Figure 2:
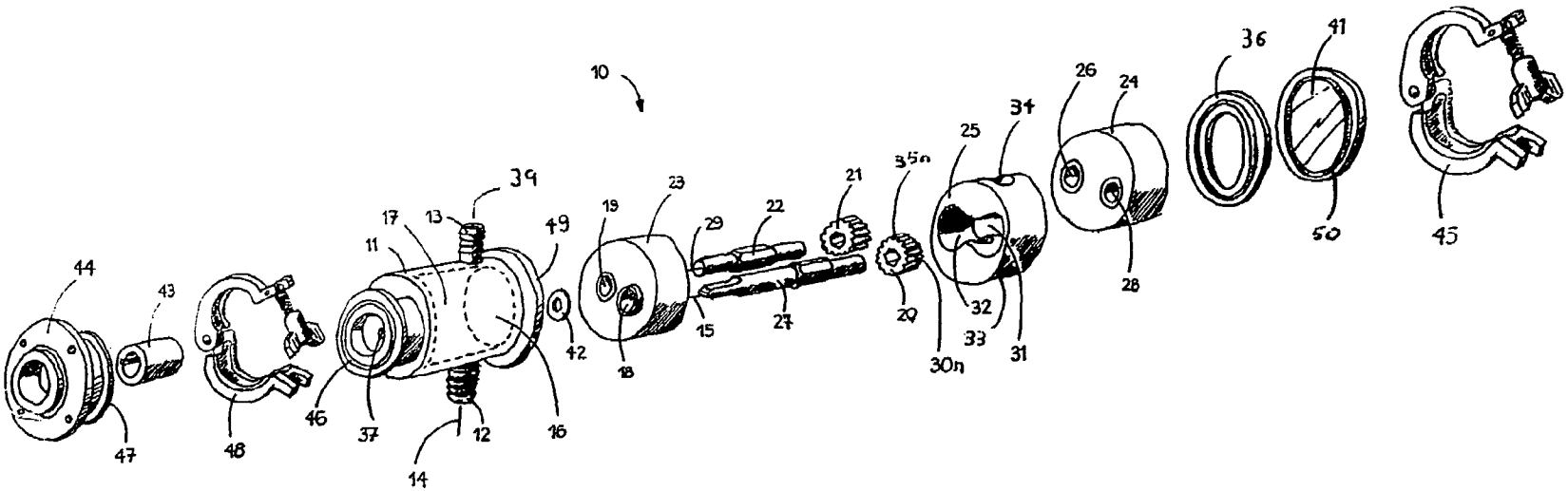
FIG. 2 is an exploded view of the pump with the internal components shown along their functioning axes.

FIG. 2 illustrates an exploded view of the pump designated generally by numeral 10 which includes a housing 11. From the pump housing 11 projects an inlet port 12 for admitting material into the pump casing 11, and an outlet port 13, for discharging pumped material.

FIG. 2 further illustrates the cooperation between drive shaft 27, drive shaft axis 15, idler shaft 22, idler shaft axis 29, with the first end block 23 and second end block 24 is substantially sufficient to maintain the internal members of the pump members 18-35 in a preferred functional alignment and for first end block 23, second end block 24 and middle block 25 to rotate about the drive axis 15 within the available pump cavity 17 to find their position of least communication. This technique eliminates the need for separate alignment means which may include independent alignment pins or alignment reference marks disposed on various pump members and allows for a substantial degree of cooperative self-positioning of the functional members within the pump housing about the drive shaft axis 15.

Protruding from pump casing 11, through drive shaft opening 37, is drive shaft 27, that is supported and guided by the extended bushing 18 disposed in first end block 23 and by wear bushing 28, disposed in end block 24.

Disposed on drive shaft 27, is a first pumping wheel 20, which through intermeshing means provides a rotational force to idler pumping wheel 21.

Disposed on the drive shaft 27 is a suitable coupling 43 for connection to an electric motor (not shown in the drawings). The electric motor is provided to impart rotary movement to the drive shaft 27 in order to drive the internal pumping mechanism as it will be described below.

FIG. 2 further illustrates that middle block 25 disposing gear chamber 31 and inner chamber surface 32. Other than being disposed in the pump body cavity, middle block 25 cooperates with, but is not attached to any members of the pump members 18-35. The free floating nature of the middle block 25 permits block 25 to self-orient and attain a least co-operational position within pump 10, thereby achieving a substantially lower level of rotary resistance than that of a more movement restricted middle member 25 that may have been incorrectly positioned and locked into a non-preferable location as may be effected in other 'non-floating' designs. The rotary resistance becoming a source of unwanted abrasion of the members that are in intimate contact and contributing to the unwanted production of particles abraded from the surfaces in contact.

The first inlet port 12 disposed on the pump casing 11 is in cooperation with the second inlet port 33 disposed in the middle member 25. The first outlet port 13 disposed on the pump casing 11 is in cooperation with the second outlet port 34 disposed in the middle member 25. Thus, the second inlet port 33 on the middle member 25 admits fluid into pumping chamber 31 for purposes of being pumped by pumping wheels 20, 21 around the internal surface 32 of the pumping chamber 31, to the second outlet port 34 disposed in the middle member 25.

Re-meshing of the pumping wheels 20, 21 substantially near second outlet port 34 serves to squeeze the transferring product out of the interprojection spaces 35*n* between the pumping wheel projections 30*n*.

Since the first inlet port 12 on the pump casing 11 cooperates with the second inlet port 33 and the first outlet port 13 on the pump casing 11 cooperates with the second outlet port 34 disposed in middle member 25, fluids are eventually transferred from the first inlet port 12 on the pump casing 11 to the first outlet port 13 on the pump casing 11 when pump 10 is in preferred operation.

FIG. 2 also illustrates the relationship of the circumferential clamp 45 acting to draw end cap flange 50 disposed on end cap 41 closer to the pump casing clamping flange 49 disposed on the open side of the pump casing 11, compressing elastomeric seal 36 interposed between end cap flange 50 and pump casing clamping flange 49. This clamping action effects to substantially seal pump 10 from unwanted outside contaminants and leaks from within pump 10. Shaft seal 42 completes the sealing requirements for pump 10 by presenting itself as a resilient interface between the rotating drive shaft 27 and the pump casing 11.

Pumping wheel 20 and pumping wheel 21 are substantially identical, the only difference arises from their disposed locations. Pumping wheel 20 is driven substantially from the prime mover, and idler pumping wheel 21 is in turn driven from drive pumping wheel 20. This is a substantial outcome of the two pumping wheels 20, 21 being in a cooperative mesh arrangement.

Figure 3:
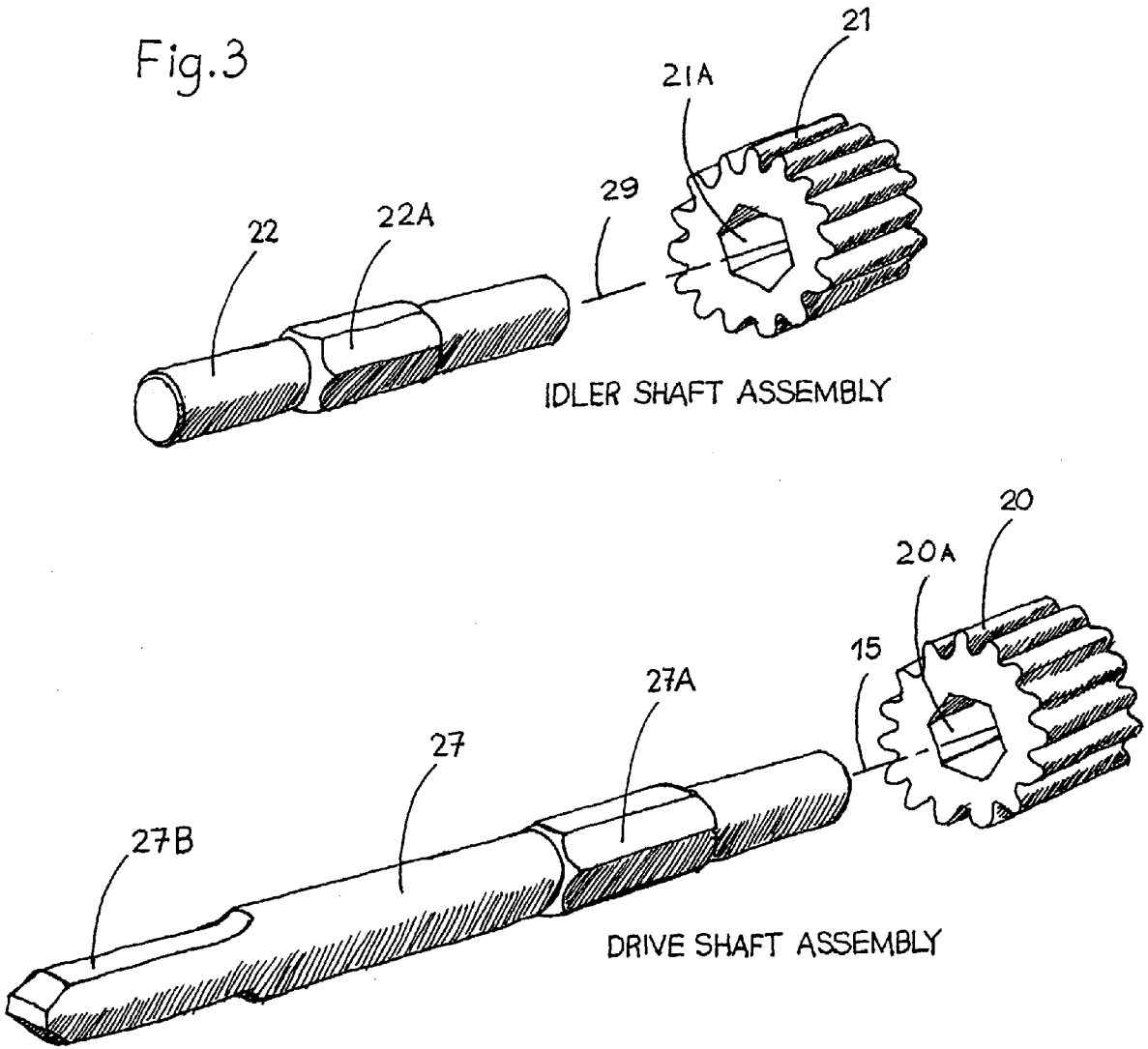
FIG. 3 is a view of the drive shaft member and idler shaft member illustrating the sliding and engaging mechanism for the pumping wheels.

FIG. 3 illustrates the cooperation of the drive shaft 27 with first pumping wheel 20. As can be seen, a section of drive shaft 27*a*, disposes a hexagonal engaging surface with bore 20*a* of drive pumping wheel 20. Thus drive shaft 27 can impart a rotary movement to drive pumping wheel 20 as well as pumping wheel 20 being able to substantially slide along hexagonal section 27*a* disposed on drive shaft 27. Most polygon surfaces effected about axis 15 of drive shaft 27 may be able to provide driving and sliding ability to pumping wheel 20, however, polygons disposing less than about 6 sides clearly require sharper pumping wheel bore angles in the receiving bore 20*a* of pumping wheel 20 that may concentrate drive forces in a fewer number of internal corners in bore 20*a* of pumping wheel 20, leading to premature failure of the integrity of drive pumping wheel 20.

Symmetrical shapes disposing more than 6 sides may tend to eventually round off the internal bore 20*a* of the pumping wheel due to the required driving forces, eventually leading to loss of engagement between drive shaft 27 and pumping wheel 20.

FIG. 3 also illustrates cooperation of idler shaft 22 with second (idler) pumping wheel 21. The operation and logic behind the functioning of this assembly is consistent with that of drive shaft 27 and drive shaft pumping wheel 20.

Figure 4:
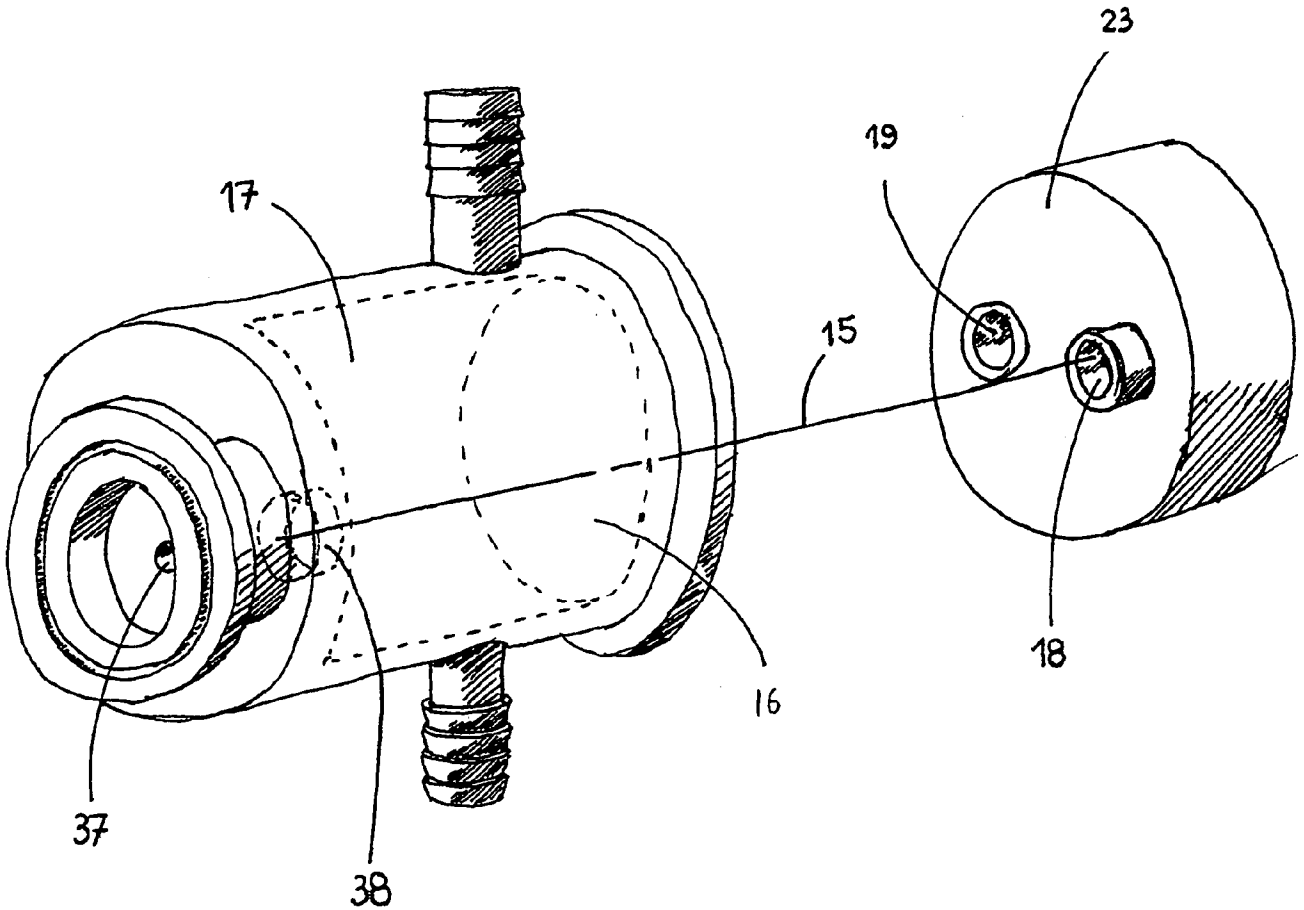
FIG. 4 is an exploded view of the pump casing and the end block support closest to the drive shaft opening disposed in the pump casing. The drawing illustrates the communication between the extended bushing disposed in the first end block and the receiving recess in the pump casing for a section of protruding extended bushing for substantially maintaining the alignment of the first end block within the pump housing.

FIG. 4 illustrates wear bushing 19 and extended bushing 18 disposed in end block 23. Recess 38 in pump casing 11 is substantially coaxial with drive shaft opening 37 and acts to receive a portion of extended bushing 18 means to effect substantial alignment between functioning members 18-35 disposed in pump cavity 17 and drive shaft axis 15.

Figure 5:
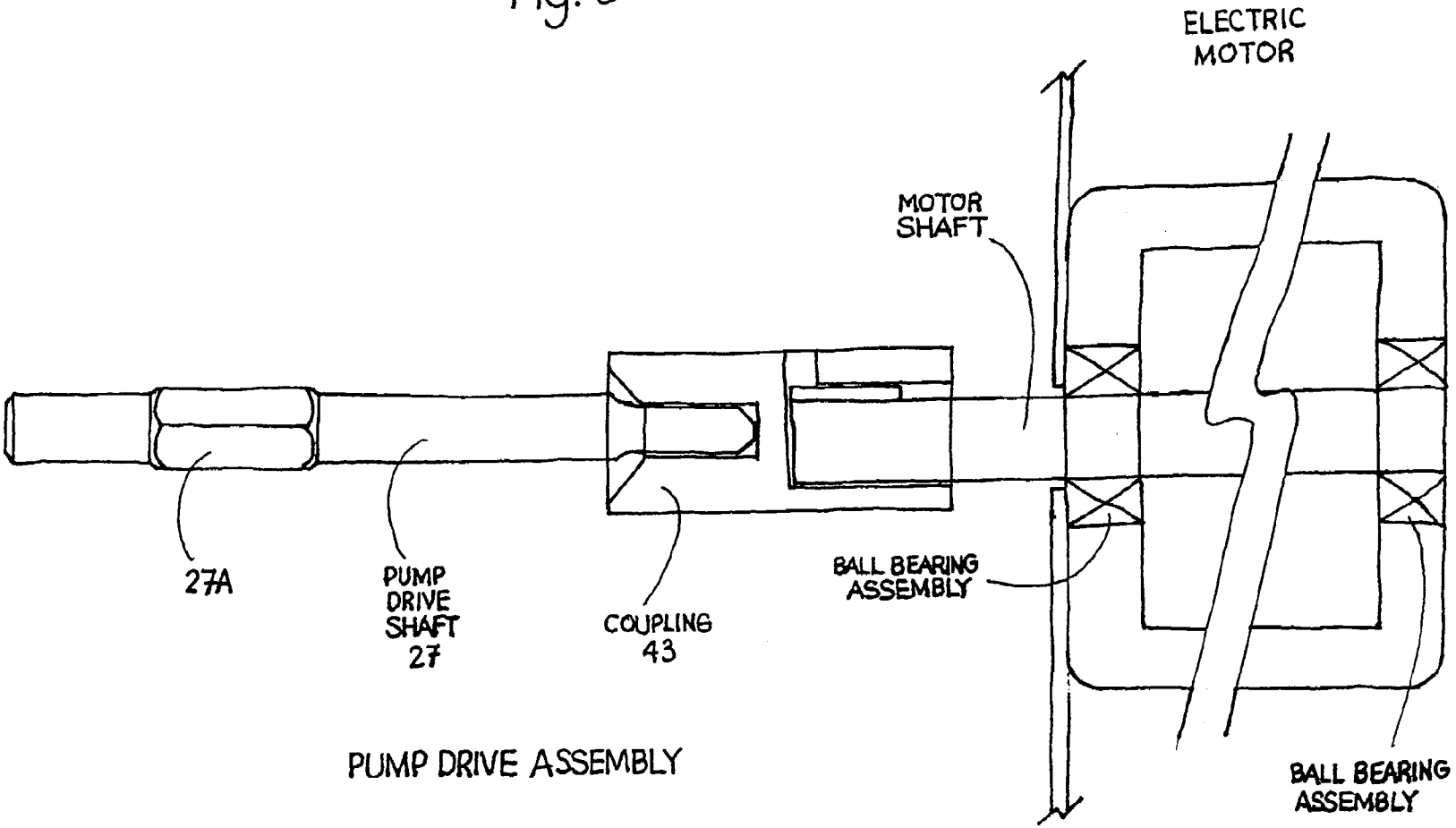
FIG. 5 illustrates the communication of the pump drive shaft to the bearings of the prime mover and how the motor output shaft and pump drive shaft are fully inserted into the coupling to provide a close communication between members.

FIG. 5 illustrates the cooperation of pump drive shaft 27 to support bearings of the prime mover. It illustrates the communication of pump drive shaft 27 to the bearings of the prime mover and how the motor output shaft and pump drive shaft 27 are fully inserted into the coupling 43 to provide a close communication between the members. The support bearings in many electric motors are of the ball bearing type where a group of hardened metal balls arranged in a circular configuration substantially maintained within dual races provide support for the operating shaft of an electric motor. In addition to providing support for the rotating shaft in the motor, this type of bearing is able to withstand substantial thrust loading along the axis of its rotation.

FIG. 5, illustrates how forces axial with the pump drive shaft 27 are transferred to the ball bearings of the electric motor instead of to surfaces within the pump which may contribute to the generation of unwanted particulates from those surfaces.

Hexagonal section 27*a* disposed on drive shaft 27 contributes by being able to slidably engage pumping wheel 20 as shown in FIG. 3 and still be able to slightly move along its axis of rotation to maintain a preferred communication with the bearings of the electric motor.

Pump 10 comprises a casing 11 having a first inlet port 12 and a first outlet port 13 through which a fluid can be transferred. A mounting arrangement 46-48 for casing 11 permits infinite rotational orientation of pump casing 11 about the axis 15 of the drive shaft 27. Pump 10 features an internal cavity 17 disposed in casing 11, internal cavity 17 carrying an arrangement of pumping components 18-35 to be described hereinafter that cooperate with first inlet port 12 and first outlet port 13 of casing 11 to move fluid through pump 10. Pumping components within internal cavity 17 comprise a middle block 25, at least one pumping wheel 20, at least one shaft 27 and at least two end blocks 23, 24, the function of each component 18-35 also fully described hereinafter. Middle block 25 includes a second internal inlet port 33 in communication with first inlet port 12 and substantially along the same axis 14 as first inlet port 12 for further admitting fluid into pumping chamber 31, a second internal outlet port 34 disposed in middle block 25 in communication with first outlet port 13 substantially along the same axis 39 as first outlet port 13 for discharging fluid from pumping chamber 31 through first outlet port 13 of pump casing 11. Extended shaft bushing 18 maintains drive shaft 27 in a preferred axis of rotation. Functional alignment of components 18-35 disposed within pump casing 11 is substantially maintained by drive shaft 27 and idler shaft 22 that are rotationally supported within end blocks 23, 24. Idler shaft 22 is disposed completely internally within cavity 17 and rotates freely in bushings 26, 19, wear bushing 19 disposed in first block 23 and bushing 26 disposed in second block 24. Shafts 27, 22 carry one or more pumping wheels 20, 21 slidably mounted and engaged for rotation about separate axes 15, 29, pumping wheels 20, 21 having a plurality of angularly spaced projections 30-30*n*, slidably engaging an internal peripheral surface 32 of pumping chamber 31 thereby defining interprojection pockets 35-35*n* therebetween wherein interprojecting pockets 35-35*n* capture fluid therein for transporting fluid through pumping chamber 31 between second internal inlet port 33 and second internal outlet port 34 thus transporting fluid through pump casing 11 from first inlet port 12 to first outlet port 13. Pumping wheel 20 has an internal bore 20*a* configured to mate with external surface 27*a* of drive shaft 27 and be slidably engaged therewith. Likewise, pumping wheel 21 has an internal bore 21*a* conforming to, and slidably engaged upon an exterior surface 22*a* of idler shaft 22. Though external surfaces 22*a*, 27*a* and internal bores 21*a*, 22*a* are shown in FIG. 3 as polygonal, it is fully within the scope of this invention to provide for other configurations for mating, yet rotationally engaging surfaces 21*a*/22*a* and 20*a*/27*a*. Pump casing 11 has a first opening 16 therein allowing for removal of components 18-35 and a second opening 37 through which protrudes one end 27*b* of drive shaft 27 for rotary engagement via coupler 43 to prime mover to provide rotational momentum to pumping wheels 20 and through intermeshing means, pumping wheel 21. Drive shaft 27 is supported in bushing 28 in second block 24 and passes through extended bushing 18 in first block 23.

Middle block 25 that contains pumping chamber 31 is not affixed to either block 23, 24 nor to casing 11 of pump 10 and is therefore free to slightly move about inside the pump cavity 17 automatically attaining a location that best suits the particular location of pumping wheels 20, 21 insofar as finding a position of least contact with pumping wheels 20, 21 that are disposed in pumping chamber 31. Pump 10 preferably has a single industry-standard clamp 45 which retains end cap 41 to casing 11 with elastomeric seal 36 therebetween that substantially seals pump casing 11 from both leaks and ingress of unwanted outside contaminants. Pump casing 11 of pump 10 can be mounted for normal operation in any rotational orientation about axis 15 of drive shaft 27. No threaded fasteners, as commonly used in prior art pumps, are required to maintain pump 10 in a preferred configuration suitable for pumping. Pumping wheels 20, 21 are substantially slidably engaged along axes 15, 29 of their respective support shafts 27, 22 while being rotationally active therewith. Pump 10 further includes a coupling 43 mounted to drive shaft 27 for connecting drive shaft 27 to a prime mover.

Preferably, first and second pumping wheels 20, 21 are mounted on separate shafts 27, 22, at least one of shafts 27, 22 projecting outside pump casing 11. It should be readily apparent to those skilled in the art that the inherent symmetry of middle block 25 is conducive to the safe placement and operation of middle block 25 within the pump cavity 17, in more than one orientation. Thus, middle block 25 is reversible upon assembly into cavity 17 where either face may be contiguous with block 23 and/or pumping wheel 20 disposed in cavity 31. Furthermore, it should be abundantly apparent that internal functioning components such as pumping wheels 20, 21, support shafts 22, 27, end blocks 23, 24 and middle block 25 are free to substantially float within pump cavity 17 so as to find the location of least resistance during preferred operation of the pump.

The above description of preferred embodiments should not be interpreted in any limiting manner since variations and refinements are possible which are within the spirit and scope of the present invention. The scope of the invention is defined in the appended claims and their equivalents.

We claim:

1. A pump (10) comprising a casing (11), a casing end cap (41), an elastomeric seal (36), a flange clamp (45) and pumping components, said pumping components further comprising a first end block (23), a middle block (25), a second end block (24), at least two pumping wheels (20 ,21), a drive shaft (27) and at least one idler shaft (22); said casing (11) having a first inlet port (12) and a first outlet port (13) through which a fluid can be transferred; a mounting collar (46) for said casing (11) which permits infinite rotational orientation of said pump casing (11) about an axis (15) of said drive shaft 27; said pump (10) featuring an internal cavity (17) disposed in said casing (11), said internal cavity (17) carrying an arrangement of said pumping components that cooperate with said first inlet port (12) and said first outlet port (13) of said casing (11) to move fluid through said pump (10,) said cavity (17) carrying said middle block (25), said at least one pumping wheel 20, said at least one shaft (27) and said at least two end blocks 23, 24, said middle block (25) having said second internal inlet port (33) in communication with said first inlet port (12) along an axis 14 of said first inlet port (12) for further admitting fluid into a pumping chamber (31), said second internal outlet port (34) disposed in said middle block (25) in communication with said first outlet port (13) along an axis 39 as said first outlet port (13) for discharging fluid from pumping chamber (31) through said first outlet port (13) of said pump casing (11), an extended shaft bushing 18 is disposed through said end block (23) and extends into an opening (37) in said mounting collar 46 for maintaining said drive shaft (27) in a preferred axis of rotation, alignment of said pumping components disposed within said pump casing (11) maintained by said drive shaft (27) and said idler shaft (22) that are in communication with said end blocks (23, 24), shafts (27, 22) carry one or more said pumping wheels (20, 21) slidably mounted and engaged for rotation about separate axes (15, 29), said pumping wheels (20, 21) having a plurality of angularly spaced projections (30-30*n*), slidably engaging an internal peripheral surface (32) of pumping chamber (31) thereby: defining interprojection pockets (35-35*n*) therebetween wherein interprojecting pockets (35-35*n*) capture fluid therein for transporting fluid through said pumping chamber (31) between said second internal inlet port (33) and said second internal outlet port (34) thus transporting fluid through said pump casing (11) from said first inlet port (12) to said first outlet port (13), said pump casing (11) has a first opening (16) therein allowing for removal of said pumping components and said second opening (37) through which protrudes one end (27*b*) of said drive shaft (27) for rotary engagement via coupler (43) to a prime mover to provide rotational momentum to said pumping wheels (20) and through intermeshing means, pumping wheel (21), said end blocks (23, 24) and said middle block (25) free to slightly move about inside said pump cavity (17), automatically attaining a location that best suits the particular location of with said pumping wheels (20, 21) disposed in said pumping chamber (31).

2. A pump (10) as defined in claim 1, where said pumping wheels (20, 21) are slidably engaged with respective support shafts (27, 22) and floatable along axes (15, 29) of said respective support shafts (27, 22).

3. A pump (10) as defined in claim 1, where inherent symmetry of said middle block (25) permits said middle block (25) to be insertable in said pump cavity (17), in multiple orientations.

* * * * *